US010222040B2

(12) United States Patent
Tigchelaar et al.

(10) Patent No.: US 10,222,040 B2
(45) Date of Patent: Mar. 5, 2019

(54) LIGHTING DEVICE ASSEMBLY AND A METHOD OF MOUNTING A LIGHTING DEVICE ASSEMBLY

(71) Applicant: KONINKLIJKE PHILIPS N.V., Eindhoven (NL)

(72) Inventors: Inge Johanna Tigchelaar, Eindhoven (NL); Tewe Hiepke Heemstra, Veldhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 540 days.

(21) Appl. No.: 14/893,196

(22) PCT Filed: May 15, 2014

(86) PCT No.: PCT/EP2014/059900
§ 371 (c)(1),
(2) Date: Nov. 23, 2015

(87) PCT Pub. No.: WO2014/191208
PCT Pub. Date: Dec. 4, 2014

(65) Prior Publication Data

US 2016/0097492 A1 Apr. 7, 2016

(30) Foreign Application Priority Data

May 28, 2013 (EP) ..... 13169409

(51) Int. Cl.
*F21K 9/27* (2016.01)
*F21V 23/04* (2006.01)
(Continued)

(52) U.S. Cl.
CPC ..... *F21V 23/04* (2013.01); *F21K 9/27* (2016.08); *F21K 9/64* (2016.08); *F21K 9/69* (2016.08);
(Continued)

(58) Field of Classification Search
CPC ..... F21K 9/275; F21V 23/04
See application file for complete search history.

(56) References Cited

U.S. PATENT DOCUMENTS

2011/0006688 A1* 1/2011 Shim ..... F21V 5/08 315/119
2011/0149564 A1 6/2011 Hsia et al.
(Continued)

FOREIGN PATENT DOCUMENTS

CN 201382283 Y 1/2010
CN 201448638 U 5/2010
(Continued)

OTHER PUBLICATIONS

Merriam-Webster's Online Dictionary definition of Prism, accessed Apr. 14, 2018.*

*Primary Examiner* — Robert J May
*Assistant Examiner* — Leah S Macchiarolo
(74) *Attorney, Agent, or Firm* — Akarsh P. Belagodu

(57) ABSTRACT

A lighting device assembly comprising an elongate base member (3) having a wall portion (9) on which several light emitting diodes (11) are mounted along the length of the base member, and an end cap (15) including an electrical terminal (17) at each respective end of the base member. The lighting device assembly further has an elongate light transmissive optical member (5) configured to be assembled with the base member, thereby enclosing the light emitting diodes. The base member is provided with at least one switch (55) configured to close an electric circuit connecting the light emitting diodes with the electrical terminals. The optical member is provided with at least one switching portion (59), configured to close said at least one switch in conjunction with the assembly of the base member and the
(Continued)

optical member, said at least one switch being opened when the base member and the optical member are disassembled.

20 Claims, 4 Drawing Sheets

(51) Int. Cl.

| | |
|---|---|
| ***F21V 25/04*** | (2006.01) |
| ***F21V 3/02*** | (2006.01) |
| ***F21K 9/64*** | (2016.01) |
| ***F21K 9/69*** | (2016.01) |
| ***F21V 3/08*** | (2018.01) |
| *F21V 5/02* | (2006.01) |
| *F21Y 103/10* | (2016.01) |
| *F21Y 115/10* | (2016.01) |

(52) U.S. Cl.
CPC ..... *F21V 3/02* (2013.01); *F21V 3/08* (2018.02); *F21V 25/04* (2013.01); *F21V 5/02* (2013.01); *F21Y 2103/10* (2016.08); *F21Y 2115/10* (2016.08)

(56) References Cited

U.S. PATENT DOCUMENTS

| | | | | |
|---|---|---|---|---|
| 2011/0176297 | A1 | 7/2011 | Hsia et al. | |
| 2012/0176768 | A1 | 7/2012 | Wu et al. | |
| 2013/0128574 | A1 * | 5/2013 | Ivey ..... | F21V 23/06 362/235 |

FOREIGN PATENT DOCUMENTS

| | | | | |
|---|---|---|---|---|
| CN | 202203693 | U | 4/2012 | |
| CN | 102454933 | A | 5/2012 | |
| CN | 202338800 | U | 7/2012 | |
| DE | 444525 | C | 5/1927 | |
| DE | 1157567 | B | 11/1963 | |
| DE | 202012101763 | U1 | 7/2012 | |
| EP | 2228599 | A1 | 9/2010 | |
| EP | 2489929 | A2 | 8/2012 | |
| GB | 2369256 | A | 5/2002 | |
| JP | H05325628 | A | 12/1993 | |
| JP | 2011044429 | A | 3/2011 | |
| WO | 2010069983 | A1 | 6/2010 | |
| WO | WO 2010150158 | A1 * | 12/2010 | ..... F21V 23/04 |
| WO | 2011086042 | A1 | 7/2011 | |
| WO | 2011158142 | A1 | 12/2011 | |
| WO | 2012004708 | A2 | 1/2012 | |

* cited by examiner

LIGHTING DEVICE ASSEMBLY AND A METHOD OF MOUNTING A LIGHTING DEVICE ASSEMBLY

CROSS-REFERENCE TO PRIOR APPLICATIONS

This application is the U.S. National Phase application under 35 U.S.C. § 371 of International Application No. PCT/EP2014/059900, filed on May 15, 2014, which claims the benefit of European Patent Application No. 13169409.3, filed on May 28, 2013. These applications are hereby incorporated by reference herein.

FIELD OF THE INVENTION

The present invention relates to a lighting device assembly comprising an elongate base member having a wall portion on which several light emitting diodes are mounted along the length of the base member, and an elongate light transmissive optical member configured to be assembled with the base member, thereby enclosing the light emitting diodes.

BACKGROUND OF THE INVENTION

TL (luminescent/fluorescent tube) lighting devices exist in different form factors, such as those called T12, T8, and T5, e.g. having different diameters where T5 has the smallest diameter. Large efforts have been spent on reconstructing the traditional fluorescent tube having a combined electrode-gas light emitter by means of LEDs (Light Emitting Diodes). This tubular lighting device is called LED TL lighting device, and it is a tube having the same form factor and typically the same electrical terminals as a corresponding traditional TL lighting device, but it is provided with LEDs as light emitters. Several LEDs are arranged on an elongate base member, along the length of the tube, in one or more rows or some other configuration. However, the diameter of a form factor T5 lighting device is small and complicates the LED mounting. Luminaires often offer some extra space in the direction of the light output, inviting the use of a larger form factor lighting device, but there is not enough mounting space to install such a larger form factor lighting device.

Additionally, a LED TL lighting device that uses the original form factor socket and a rewired driver of the luminaire is subject to some safety risks. There may be a risk of electrical shock if the LEDs or PCB traces can be touched by hand.

Also, it is possible that the LEDs are blue LEDs that may be too bright for direct on-looking; they should be operated only when there is no direct line of sight onto the LEDs, and all light is reflected or transmitted by a Remote Phosphor layer.

SUMMARY OF THE INVENTION

It would be advantageous to provide a lighting device assembly that alleviates the above-mentioned problems of the prior art.

To better address this concern, in accordance with an aspect of the present invention, there is provided a lighting device assembly comprising an elongate base member having a wall portion on which several light emitting diodes are mounted along the length of the base member, and an end cap including an electric terminal at each respective end of the base member. The lighting device assembly further comprises an elongate light transmissive optical member configured to be assembled with the base member, thereby enclosing the light emitting diodes. The base member is provided with at least one switch configured to close an electric circuit connecting the light emitting diodes with the electric terminals. The optical member is provided with at least one switching portion, configured to switch said at least one switch in conjunction with the assembly of the base member and the optical member. The at least one switch is/are opened when the base member and the optical member are disassembled.

By providing the lighting device as an assembly comprising the base member and the optical member, and having the switching arrangement, the base member can be inserted into a luminaire without any risk. Furthermore, there is a freedom in designing the optical member. For example, it can be designed according to a different form factor than the base member if allowed by the available space of the luminaire, or it can be designed with an optional shape.

In accordance with an embodiment of the lighting device assembly, said at least one switch is mounted at an opposite side of the wall portion in relation to the light emitting diodes. This embodiment is advantageous in that the switches are hidden behind the wall portion.

In accordance with an embodiment of the lighting device assembly, the wall portion is provided with at least one opening configured to receive said at least one switching portion.

This is a simple way of arranging the switching function.

In accordance with an embodiment of the lighting device assembly, at least one of the one or more switching portions comprises a magnet.

Thereby no openings are necessary in the wall portion.

In accordance with an embodiment of the lighting device assembly, said at least one switch comprising at least two make/brake contacts, each one thereof switching the LEDs to the electric terminals of a respective one of the end caps.

In accordance with an embodiment of the lighting device assembly, the base member is hollow.

In accordance with an embodiment of the lighting device assembly, the base member has a generally semi-circular cross-section.

Thereby, the base member is optimised for replacing conventional TL lighting devices in existing luminaires.

In accordance with an embodiment of the lighting device assembly, each one of said at least one switching portion is a protrusion, and has a retaining portion configured to engage with the base member in an assembled state.

Thereby, the switching function and the retaining function are combined in one and the same element.

In accordance with an embodiment of the lighting device assembly, the optical member has a larger maximum width than the base member.

Due to the mechanical properties of the sockets of TL lighting devices, when the width of the optical member is correctly chosen, the only possible mounting order will be to first install the base member, and only then engage the optical member with the base part, which eliminates the electrical safety risk of associated with touching LEDs and PCB traces.

By employing the space within a luminaire in this way, the lighting properties can be improved.

In accordance with an embodiment of the lighting device assembly, the optical member has inclined side walls having a respective reflective inner surface, and a front prism plate connected with the side walls. This embodiment provides good opportunities for reducing glare and obtaining a stronger directionality of the emitted light. It should be noted that, for example, the reflective inner surface could optionally be provided with remote phosphor in reflective mode, and front prism plate could be provided with remote phosphor in transmissive mode.

The object defined above is further achieved by a method of mounting a lighting device assembly according to the present invention as defined in claim 10.

Thus, in accordance with an aspect of the present invention, there is provided a method of mounting a lighting device assembly comprising an elongate base member having a wall portion on which several light emitting diodes are mounted in a row, along the length of the base member, and having an end cap including an electrical terminal at each respective end of the base member, and an elongate light transmissive optical member, the mounting method comprising:

mounting the base member by entering the electrical terminals of its end caps into terminal receptors of a luminaire, rotating the base member to lock the electrical terminals; and mounting the optical member at the base member, thereby enclosing the light emitting diodes, and thereby closing an electric circuit connecting the light emitting diodes with the electrical terminals by means of at least one switching portion of the optical member that switches at least one switch of the base member.

The method provides advantages corresponding to those of the lighting device assembly as explained above.

These and other aspects, and advantages of the invention will be apparent from and elucidated with reference to the embodiments described hereinafter.

BRIEF DESCRIPTION OF THE DRAWINGS

The invention will now be described in more detail and with reference to the appended drawings in which.

DESCRIPTION OF PREFERRED EMBODIMENTS

Figure 1:
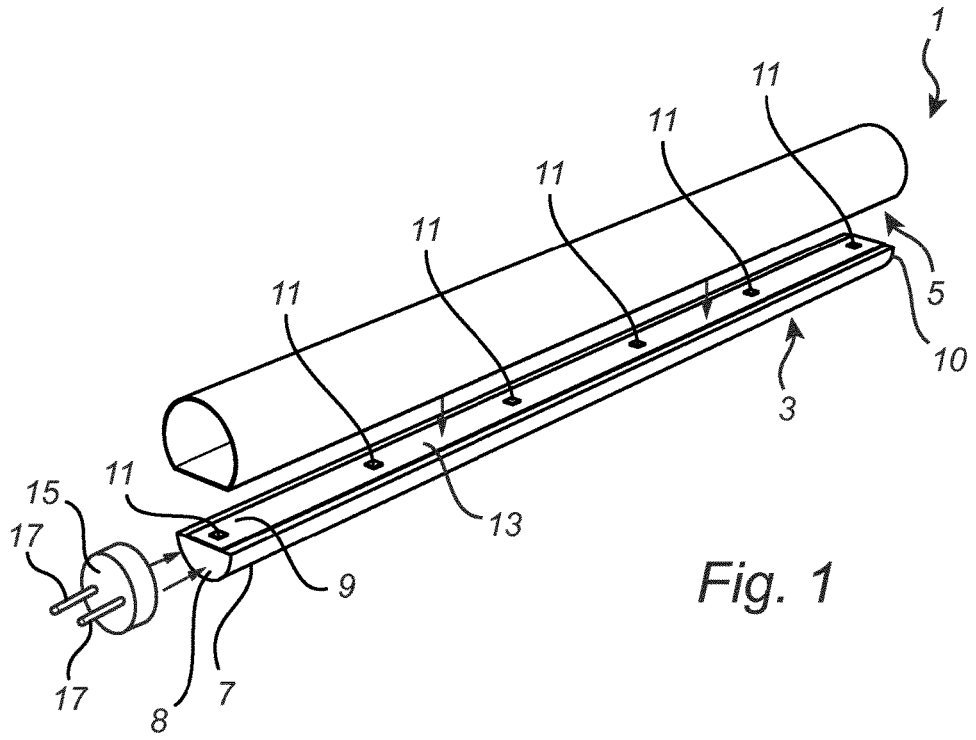
FIG. 1 is a perspective view of an embodiment of the lighting device assembly according to the present invention.
Figure 2A:
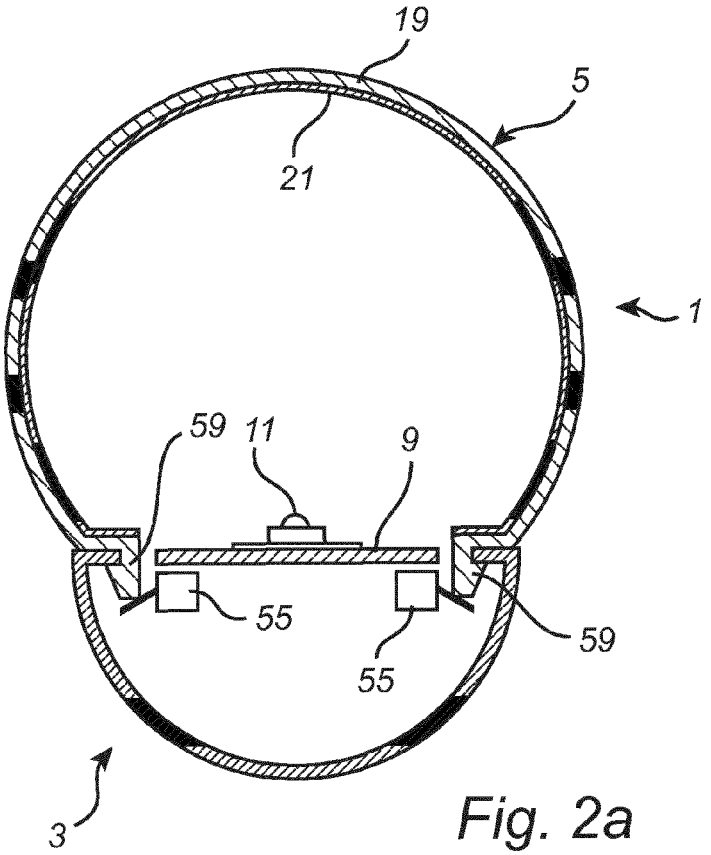
FIGS. 2*a* to 2*c* illustrate an embodiment of a switching portion of the lighting device assembly.

According to an embodiment of the lighting device assembly 1, as shown in FIG. 1, it comprises a base member 3 and an optical member 5. Both the base member 3 and the optical member 5 are elongate. The base member 3 is tubular, and has a semicircular cross-section, thus having a first wall portion 7, which is shaped as a half pipe, covered by a second wall portion 9, which in this embodiment is rectangular and plate shaped. Further, the base member 3 comprises several LEDs 11, which are arranged in one or more rows along the length of the base member 3. There are of course a large number of possible arrangements of the LEDs 11. More particularly, the LEDs 11 are mounted on a strip shaped LED carrier 13, such as a PCB (Printed Circuit Board). The base member 3 is furthermore provided with end caps 15, mounted at each end 8, 10 of the base member 3. Each end cap 15 comprises an electrical terminal 17, such as two pins, configured to be inserted in sockets of a luminaire. For purposes of illustrating the base member, only one end cap is shown and it is shown before being mounted at the end of the base member 3. The LEDs 11 are electrically connected with the electrical terminal 17 via at least one switch 55, as will be explained in detail below. Referring to FIG. 2*a*, showing the lighting device assembly 1 in an assembled state, i.e. constituting a lighting device, the optical member 5 is light transmissive, and comprises a carrier layer 19 constituting a body of the optical member 5 of a suitable material such as a plastic, and optionally a phosphor layer 21 deposited on an inner surface of the carrier layer 19 facing the LEDs 11. The phosphor layer 21 constitutes a remote phosphor from the LEDs' 11 perspective, and it can be selected to be in transmissive mode as well as in reflective mode. Furthermore, the phosphor layer 21 can cover a part of the carrier layer 19, and the phosphor layer 21 may optionally be implemented as a foil. Also, the optical member 5 may optionally be composed of a mixture of phosphor and a transparent material.

Figure 3A:
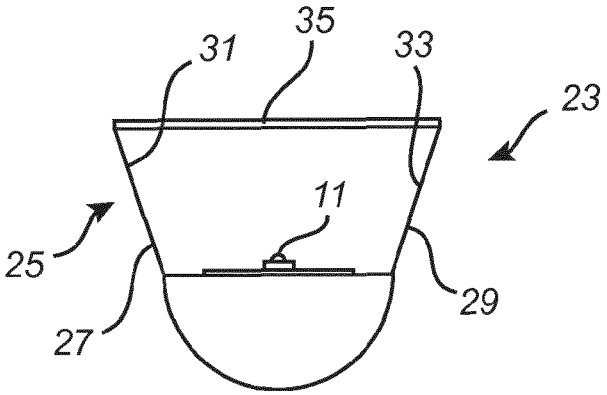
FIGS. 3*a* to 3*c* are schematic cross-sectional views of assembled lighting devices illustrating different designs.
Figure 3B:
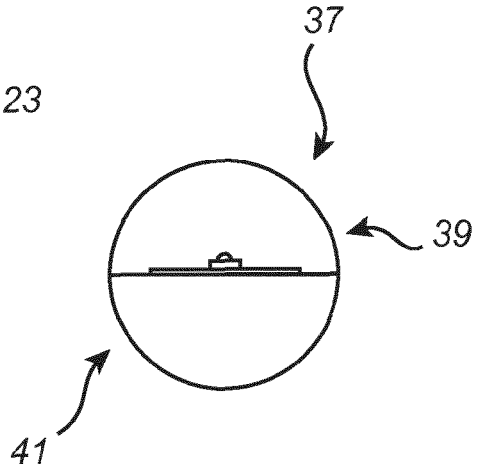
Figure 3C:
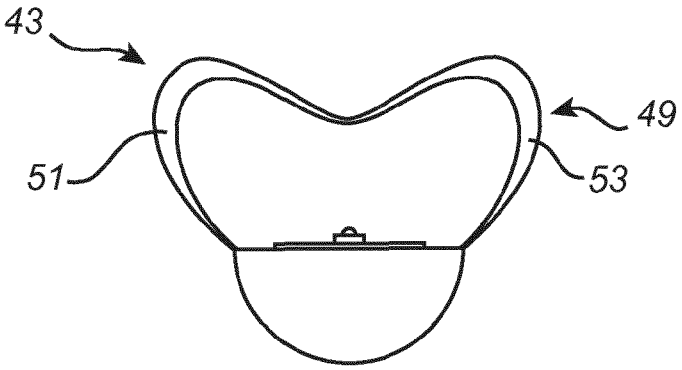

Furthermore, in this embodiment, the optical member 5 is mushroom shaped and has a larger maximum width than the base member 3. Thereby the interior space of a typical conventional luminaire, in particular in luminaires built for T5 lighting devices, is fully utilized while facilitating the construction of the lighting device assembly 1. Many other shapes of the optical member 5 are feasible, as exemplified in FIGS. 3*a* to 3*c*. Thus, according to another embodiment of the lighting device assembly 23, the optical member 25 has a generally triangular cross-section. The optical member 25 comprises inclined side walls 27, 29 having a respective reflective inner surface 31, 33 with optional reflective remote phosphor layer, and a front prism plate 35, with optional transmissive remote phosphor layer, connected with the side walls 27, 29. In this embodiment a part of the light emitted by the LEDs 11 is reflected by the side walls 27, 29 towards the front prism plate 35, and the rest of the emitted light reaches the front prism plate 35 directly. As the light passes through the front prism plate 35 it is scattered.

According to another embodiment of the lighting device assembly 37, the optical member 39 is semicircular in cross-section, and has the same diameter as the base member 41. Thus, the assembled lighting device 37 has the same outer shape as a conventional TL lighting device. This embodiment, however, does not safeguard an advantageous mounting order, which is to first mount the base member 41, and then mount the optical member 39 at the base member 41. In order to establish an additional level of electrical safety, the optical member can be provided with some protrusions, for instance pins, that make it substantially wider than the base member. In this way it will be impossible to install the lighting device in an assembled condition.

According to another embodiment of the lighting device assembly 43, the optical member 49 is generally peanut shaped in cross-section, with two similar halves 51, 53 of the peanut shape. Each half 51, 53 has a varying thickness at different portions of the cross-section. The maximum width of the optical member exceeds that of the base member.

It should be noted that in the above embodiments where the optical member is considerably wider than the base member it is not possible to mount the lighting device assembly after being assembled, since the optical member is too wide.

Figure 2B:
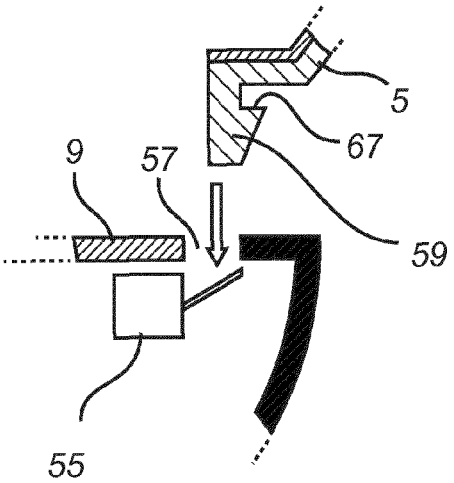
Figure 2C:
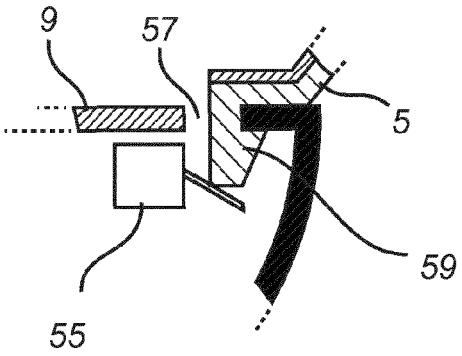

Referring to FIGS. 2*b* and 2*c*, the base member 3 comprises at least one switch, and in this embodiment there are four switches 55. The switches 55 are mounted at an opposite side of the second wall portion 9 in relation to the LEDs 11, i.e. inside of the base member 3. Thereby they are not reachable by the fingers of a person mounting the lighting device assembly. However, the second wall portion 9 is provided with openings 57 positioned at the switches 55. The switches 55 and the associated openings 57 are positioned in the vicinity of the four corners of the second wall portion 9. The optical member 5 comprises switching portions 59, which are positioned in alignment with the openings 57 such that when the lighting device assembly 1 is assembled the switching portions 59 are received in the openings 57 and switch the switches 55 to a closed state, as in FIG. 2*c*. The switches 55 should automatically return to an open state if the optical member 5 is removed, for instance by being spring biased towards the off state. When the switches 55 are closed they close an electric circuit powering the LEDs 11. By means of this switch structure the optical member 5, at both ends thereof, has to come very close to the base member 3 before the switches 55 are switched on and current starts to flow. Thereby it is impossible for the person mounting the lighting device assembly 1 to reach the current-conducting parts when current is flowing.

It should be noted that many other kinds of arrangements for how the switching portions are to actuate the switches 55 are feasible. For example, instead of the openings 57 the second wall portion 9 can be provided with flexible portions, which are bent by the switching portions 59.

Figure 4:
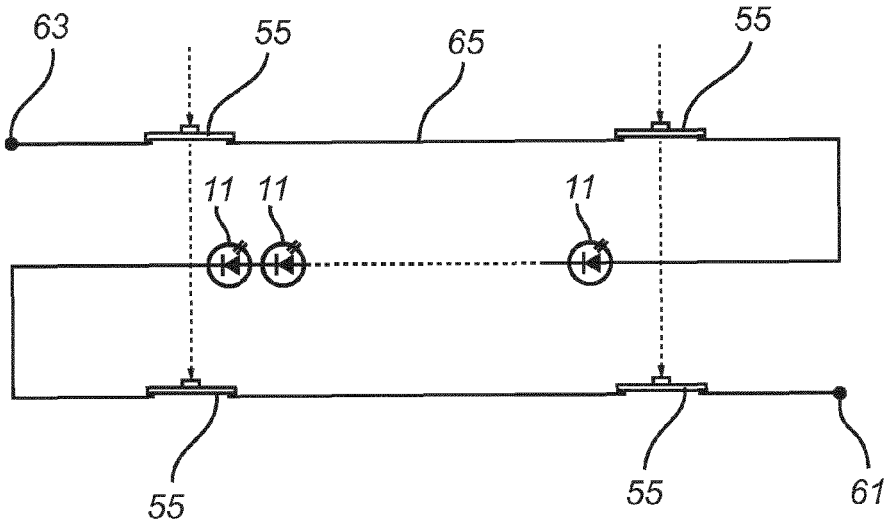
FIG. 4 is a schematic coupling diagram for the LEDs.
Figure 5:
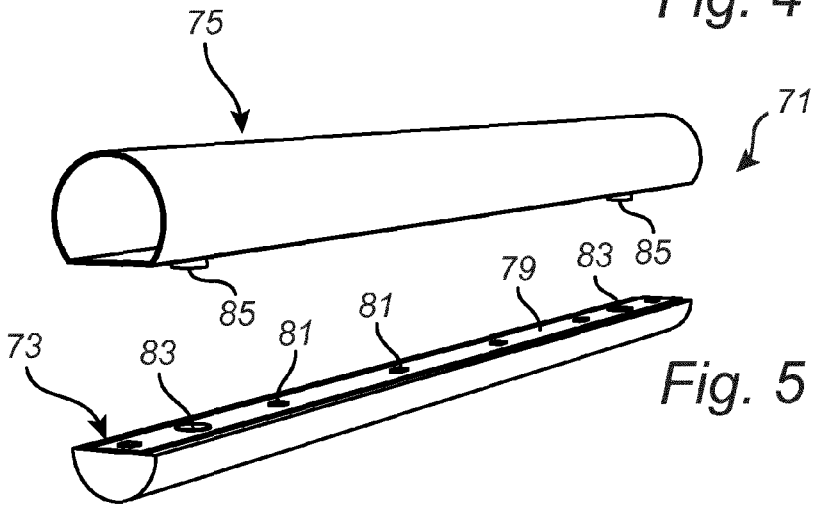
FIG. 5 is a perspective view of another embodiment of the lighting device assembly.

The electric coupling of the switches 55 and the LEDs 11 is schematically illustrated in FIG. 4, where the LEDs 11 are series connected between two electric terminals 61, 63 along an electric path 65. The four switches 55 are series connected along the electric path 65 as well.

Advantageously, the two switches at 55 a first end 8 of the base member 3 are mechanically or magnetically linked so that the switching action of these switches happens substantially simultaneously. The same holds for the two switches 55 at a second, opposite, end 10 of the base member 3.

Furthermore, advantageously, each switching portion 59 additionally comprises a retaining portion 67, configured to engage with the second wall portion 9 of the base member 3 in the assembled state. In the embodiment shown in FIG. 2*a* each switching portion 59 is embodied by a protrusion, or tongue, and the retaining portion 67 is embodied by a shoulder 67 at one side of the tongue, engaging with the inside surface of the second wall portion 9. Additional protrusions and additional openings of the second wall portion 9 can be arranged as well, providing only a retaining function. Alternatively the switching portion or portions can be fully separated from the retaining portion, or portions, and they can be designed in many different ways.

According to a further embodiment of the lighting device assembly 71 the switches are closed by magnet actuation, such as a reed switch. As above, the very switches are mounted at the inside of the base member 73, while the switching portions 85 are comprised in the optical member 75. However, here the switching portions 85 are constituted by permanent magnets, which engage with engagement areas 83 of the second wall portion 79 of the base member 73. The switches are arranged adjacent to the engagement areas 83 and are closed by the permanent magnets 85 to enable power feed to the LEDs 81. Simultaneously, the permanent magnets 85 constitute retaining portions, which retain the optical member 75 and the base member 73 in the assembled state. When the lighting device is disassembled and the magnets 85 are removed, the switches are automatically opened again.

Figure 6:
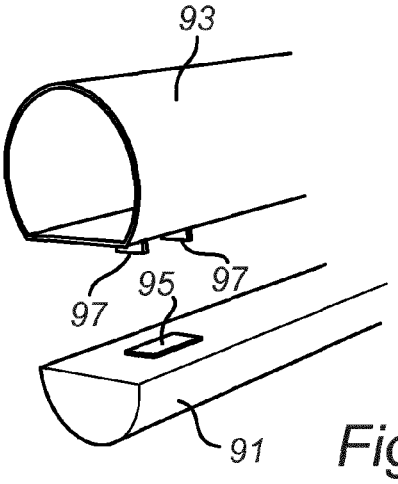
FIG. 6 is a schematic perspective view showing another embodiment of the lighting device assembly.

According to a further embodiment of the lighting device assembly, it comprises a single switch 95, arranged at the base member 91, and a switching portion 97 arranged at the optical member 93. This is most schematically shown in FIG. 6, just to illustrate the single switch idea. The switch 95 has a double contact connected with both ends of the LED strip connecting them to the respective end caps. For instance, the single switch is plate shaped and configured such that it has to be pushed down at both ends thereof, for instance by means of two spaced protrusions of the switching portion 97 respectively acting at opposite end portions of the switch 95. Additionally, or alternatively, the switch 95 is placed halfway the length of the base member 91 to minimize the distance between base member 91 and the optical member 93 at the moment of switching action, during assembly, thereby preventing access to current conducting electrical materials.

The lighting device assembly as described in the above embodiments is mounted as follows. First the base member 3 is mounted in a luminaire by entering the electrical terminals of its end caps into respective terminal receptors of a luminaire and rotating the base member 3 so that the pins 17 of the end caps 15 lock. Due to the switches 55 being in an open state there is no risk for the person mounting the base member 3 to have an electric shock. Then the optical member 5 is mounted at the base member 3. Thereby the LEDs 11 are enclosed by the optical member 5, and the switches 55 are closed such that the LEDs 11 become electrically connected with the electrical terminals 17. Consequently, the electric circuit feeding the LEDs 11 with power is closed. Since the base member 3 is mounted separately at the luminaire, including the rotation, and the optical member 5 is attached later on, the freedom of shaping the optical member 5 is increased relative to the prior art, where the lighting device is first assembled and then mounted at the luminaire. For instance, this often admits the use of a wider optical member than base member, as described above. The wide shape enforces a person assembling the lighting device to use the correct, most electrically safe, mounting order.

Above embodiments of the lighting device assembly, and the method of mounting the same, according to the present invention as defined in the appended claims have been described. These should only be seen as merely non-limiting examples. As understood by the person skilled in the art, many modifications and alternative embodiments are possible within the scope of the invention as defined by the appended claims.

It is to be noted that for the purposes of his application, and in particular with regard to the appended claims, the word "comprising" does not exclude other elements or steps, and the word "a" or "an" does not exclude a plurality, which per se will be evident to a person skilled in the art.

The invention claimed is:

1. A lighting device assembly comprising:

an elongate base member having a wall portion on which several light emitting diodes are mounted along the length of the base member;

an end cap including an electrical terminal at an end of the base member; and an elongate light transmissive optical member configured to be assembled with the base member, thereby enclosing the light emitting diodes, wherein the base member is provided with at least one switch configured to close an electric circuit connecting the light emitting diodes with the electrical terminals, and wherein at least one switching portion formed by the optical member is configured to close said at least one switch in conjunction with the assembly of the base member and the optical member, said at least one switch being opened when the base member and the optical member are disassembled.

2. The lighting device assembly according to claim 1, wherein the optical member has a larger maximum width than the base member.

3. The lighting device assembly according to claim 1, said at least one switch being mounted at an opposite side of the wall portion in relation to the light emitting diodes.

4. The lighting device assembly according to claim 1, wherein the wall portion is provided with at least one opening configured to receive said at least one switching portion.

5. The lighting device assembly according to claim 1, wherein at least one of said at least one switching portion comprises a magnet.

6. The lighting device assembly according to claim 1, said at least one switch is plate shaped, wherein the at least one switching portion comprises at least two spaced protrusions configured to engage different ends of the at least one switch.

7. The lighting device assembly according to claim 1, wherein the base member is hollow.

8. The lighting device assembly according to claim 1, wherein the base member has a generally semi-circular cross-section.

9. The lighting device assembly according to claim 1, wherein each one of said at least one switching portion is a protrusion.

10. The lighting device assembly according to claim 9, wherein each switching portion has a retaining portion configured to engage with the base member in an assembled state.

11. The lighting device assembly according to claim 1, wherein the optical member comprises a carrier layer covered by a phosphor layer on its inside facing the light emitting diodes.

12. The lighting device assembly according to claim 1, wherein the optical member has inclined side walls having a respective reflective inner surface, and a front prism plate connected with the side walls.

13. A method of mounting a lighting device assembly comprising an elongate base member having a wall portion on which several light emitting diodes are mounted along the length of the base member, and having an end cap including an electrical terminal at each respective end of the base member, and an elongate light transmissive optical member, the mounting method comprising:

mounting the base member by entering the electrical terminals of its end caps into terminal receptors of a luminaire;

rotating the base member to lock the electrical terminals; and mounting the optical member at the base member, thereby enclosing the light emitting diodes, and thereby closing an electric circuit connecting the light emitting diodes with the electrical terminals using at least one switching portion formed by the optical member that switches at least one switch of the base member.

14. The method according to claim 13, wherein the at least one switching portion is a protrusion configured to secure the optical member to the base member.

15. The method according to claim 13, wherein the at least one switching portion comprises a magnet.

16. The method according to claim 13, wherein each switching portion has a retaining portion configured to engage with the base member in an assembled state.

17. The method according to claim 13, wherein the least one switch is mounted at an opposite side of the wall portion in relation to the light emitting diodes.

18. A tube luminescent retrofit lamp comprising:

a lighting device assembly, wherein the lighting device assembly comprises:

an elongate base member having a wall portion on which several light emitting diodes are mounted along the length of the base member;

an end cap including an electrical terminal at an end of the base member; and an elongate light transmissive optical member configured to be assembled with the base member, thereby enclosing the light emitting diodes, wherein the base member is provided with at least one switch configured to close an electric circuit connecting the light emitting diodes with the electrical terminals, and wherein at least one switching portion formed by the optical member is configured to close said at least one switch in conjunction with the assembly of the base member and the optical member, said at least one switch being opened when the base member and the optical member are disassembled.

19. The tube luminescent retrofit lamp of claim 18, wherein the at least one switching portion is a protrusion configured to secure the optical member to the base member.

20. The tube luminescent retrofit lamp of claim 18, wherein the at least one switching portion comprises a magnet.

* * * * *